US005910186A

United States Patent [19]

Weschler

[11] Patent Number: 5,910,186

[45] **Date of Patent: *Jun. 8, 1999**

[54] VEHICLE REPAIRING DEVICES

[76] Inventor: Bradley R. Weschler, 8 Longwood Dr., South Huntington, N.Y. 11746

[ * ] Notice: This patent is subject to a terminal disclaimer.

[21] Appl. No.: 08/888,572

[22] Filed: Jul. 7, 1997

Related U.S. Application Data

[63] Continuation-in-part of application No. 08/620,989, Mar. 22, 1996, Pat. No. 5,644,946, which is a continuation-in-part of application No. 08/401,764, Mar. 10, 1995, abandoned, and application No. 08/401,765, Mar. 10, 1995, abandoned.

[51] Int. Cl.[6] ..... B21D 1/12

[52] U.S. Cl. ..... 72/447; 72/705

[58] Field of Search ..... 72/705, 457, 447

[56] References Cited

U.S. PATENT DOCUMENTS

| | | |
|---|---|---|
| 3,141,493 | 7/1964 | Textor, Sr. . |
| 3,292,410 | 12/1966 | Baldassano . |
| 3,691,817 | 9/1972 | Friend et al. . |
| 3,921,433 | 11/1975 | Whitney . |
| 5,031,438 | 7/1991 | Flannery . |

FOREIGN PATENT DOCUMENTS

| | | |
|---|---|---|
| 0269538 | 6/1988 | European Pat. Off. . |
| 2606806 | 8/1977 | Germany . |
| 2739528 | 3/1979 | Germany . |

*Primary Examiner*—Lowell A. Larson
*Attorney, Agent, or Firm*—Galgano & Burke

[57] ABSTRACT

A device for repairing a damaged vehicle includes a generally V-shaped base having a first substantially horizontal elongated member and a second substantially horizontal elongated member which are fixedly attachable to each other at an angle less than 90 degrees. At least a pair of slidably attachable clamps on the first member attach to two locations of a vehicle, and preferably to two pinch weld locations of a unibody. A slidably attachable clamp on the second member attaches to a third location on the vehicle, and preferably to a pinch weld location on a unibody. In one embodiment, the first member and the second member are pivotally attached to one another for varying the angle therebetween.

22 Claims, 10 Drawing Sheets

VEHICLE REPAIRING DEVICES

RELATED APPLICATIONS

This is a continuation-in-part application of U.S. patent application Ser. No. 08/620,989 filed Mar. 22, 1996, issued Jul. 8, 1997 as U.S. Pat. Ser. No. 5,644,946, which is a continuation-in-part of U.S. patent applications, Ser. Nos. 08/401,764 and 08/401,765, both filed Mar. 10, 1995, now abandoned.

BACKGROUND OF THE INVENTION

Vehicles damaged in an accident usually require expensive repairs including careful and accurate straightening and correction of the deformation. Devices for repairing damaged vehicles typically include a number of beams attached to each other at 90 degrees. In addition, they typically require the vehicle to be jacked up so that the device can be positioned under the vehicle, wherein the device is attached to the vehicle at typically four locations. Such devices are costly, require extensive time to set up, and require highly skilled technicians to operate.

It is therefore desirable to provide vehicle repairing devices which are low cost and compact, readily set up and operated, and which provide effective repair of damaged unibodies.

SUMMARY OF THE INVENTION

The various embodiments of the present invention provide vehicle repairing devices which comprise a generally V-shaped base comprising a first substantially horizontal elongated member and a second substantially horizontal elongated member attachable to each other at an angle of less than 90 degrees. A pair of clamps are attached to the first member to attach the first member to a vehicle, preferably at two different pinch weld locations. A separate clamp attaches the second member to the vehicle, preferably at another location which is different from the two pinch weld locations to which the first member is attached.

According to one embodiment of the present invention, a vehicle repairing device comprises a generally V-shaped base comprising a first substantially horizontal elongated member and a second substantially horizontal elongated member pivotally attachable to each other so as to vary the angle therebetween from between 20 degrees and 70 degrees.

Another embodiment of the present invention comprises a vehicle repairing device comprising a generally V-shaped base and means for applying a force to said vehicle repairing device.

These and other embodiments of the present invention are described below with reference to the figures.

DETAILED DESCRIPTION OF THE PREFERRED EMBODIMENTS

Figure 1:
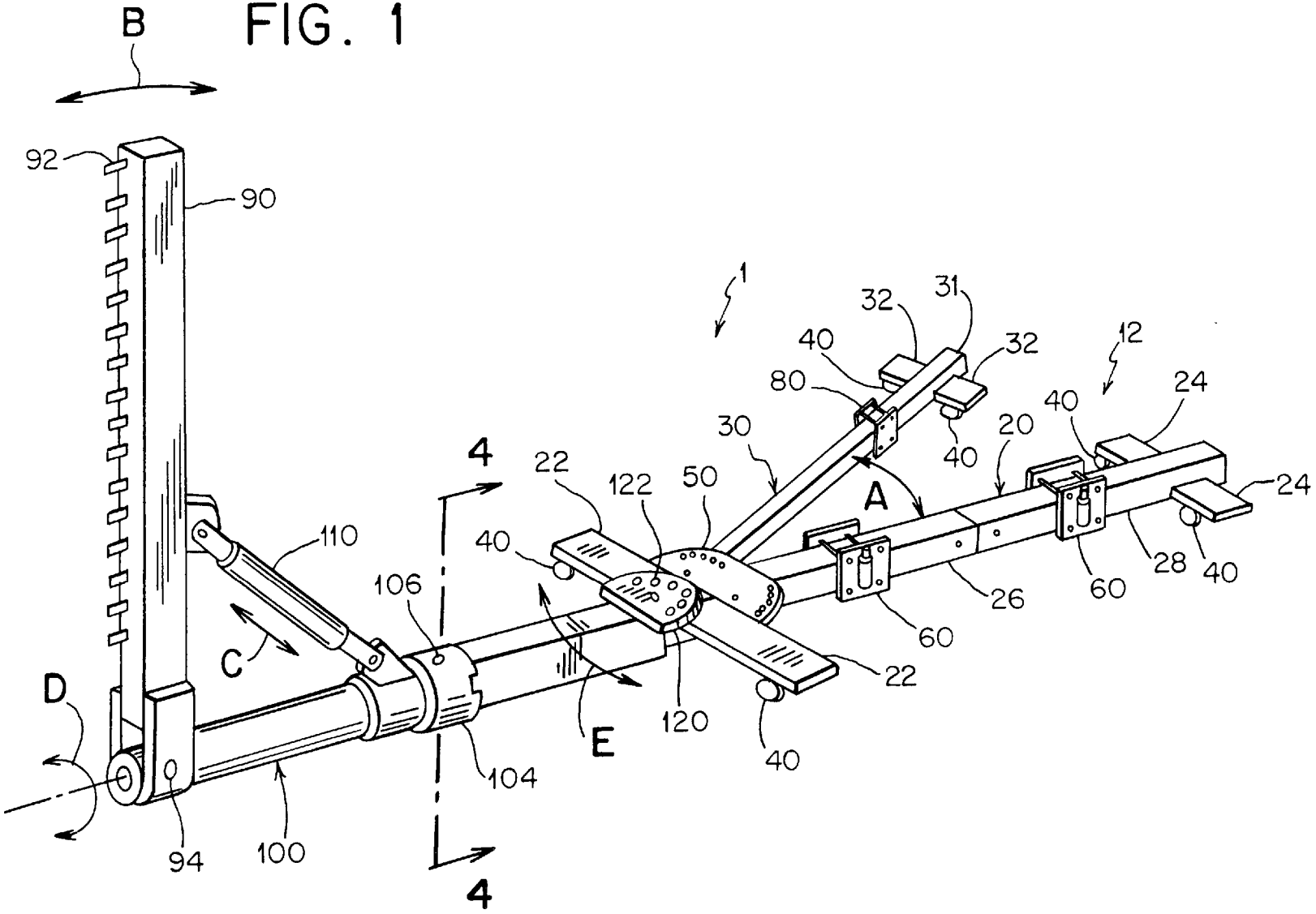
FIG. 1 is a perspective view of a vehicle repairing device of the present invention.
Figure 2:
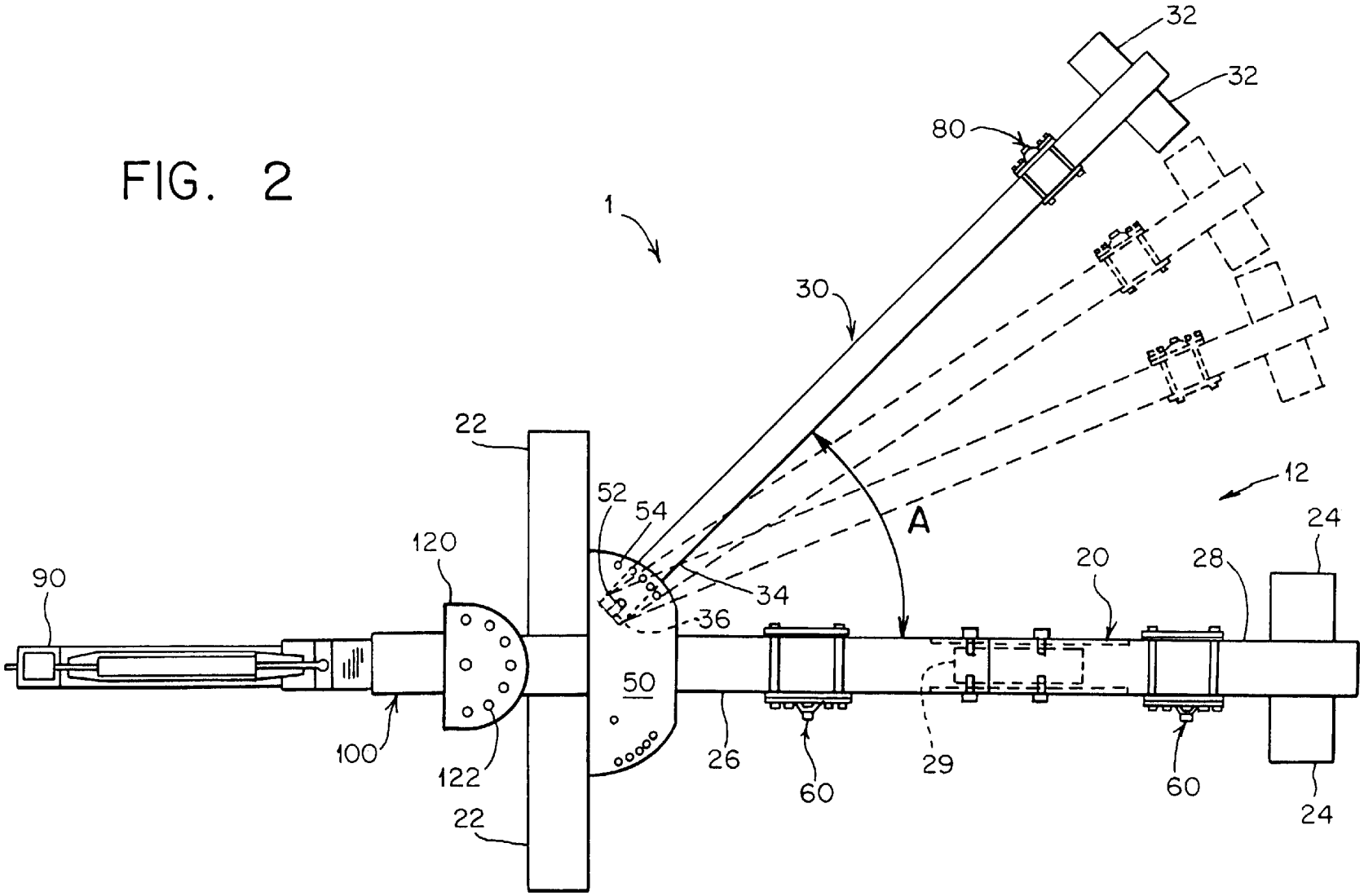
FIG. 2 is a top plan view of the vehicle repairing device shown in FIG. 1 with alternative positions of a side arm shown in dashed lines.

Turning now to the drawings, therein illustrated in FIGS. 1 and 2 is a vehicle repairing device 1 embodying the present invention for repairing a damaged vehicle unibody. Vehicle repairing device 1 generally comprises a generally V-shaped base 12 comprising a first substantially horizontal elongated member or main beam 20, and a second substantially horizontal elongated member or side arm 30, which are attachable to each other so as to define an angle A therebetween which is less than 90 degrees.

Main beam 20 and side arm 30 are preferably hollow beams and have a substantially uniform cross-section, e.g., beams having a hollow square or rectangular cross-section. Side supports 22 and 24 extend outwardly from opposite sides of main beam 20 and are provided with ground supporting wheels 40. Likewise, side supports 32 extend outwardly from opposite sides of a distal end 31 of side arm 30 and are provided with ground supporting wheels 40.

Figure 2A:
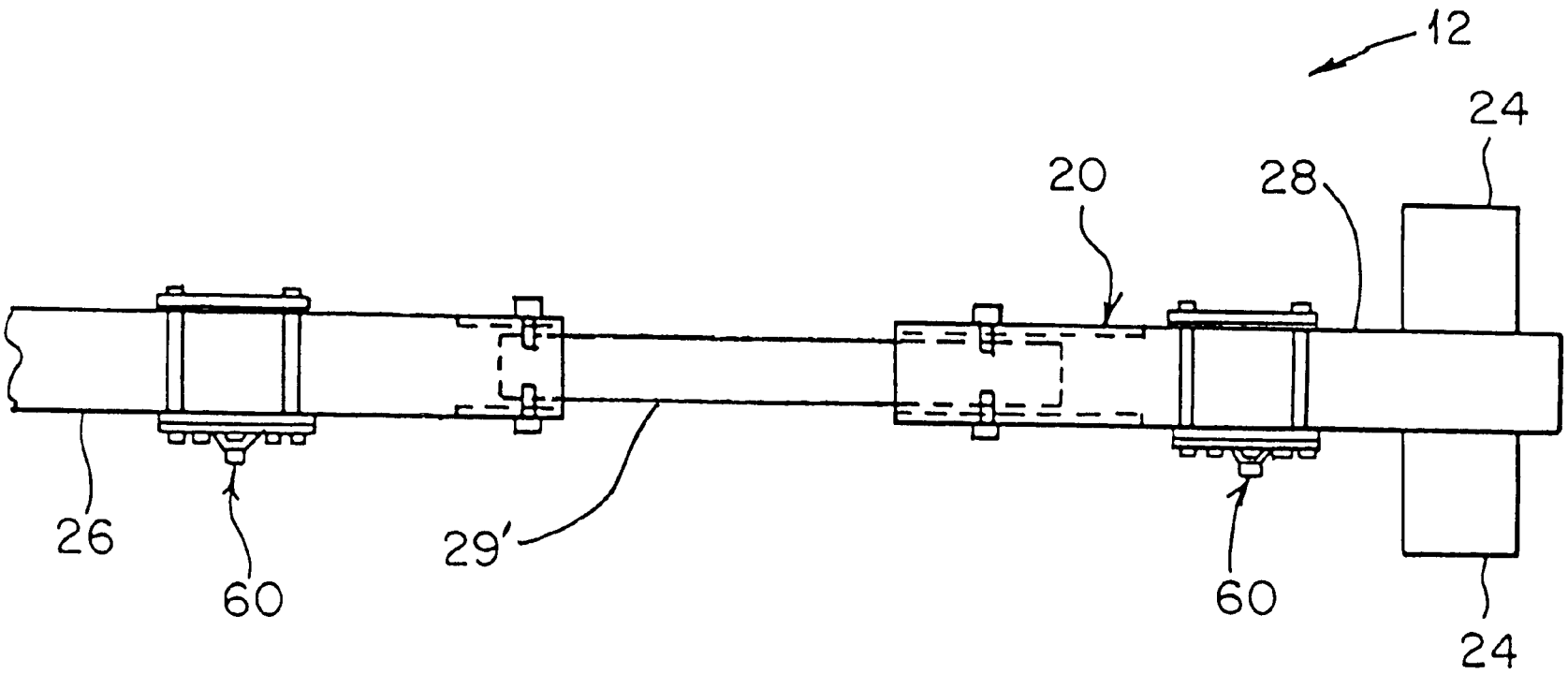
FIG. 2A is a top plan view of the main beam, shown in FIG. 2, in an extended position.

As illustrated in the embodiment shown in FIGS. 1 and 2, main beam 20, which preferably attaches to two locations on a vehicle, is sized larger relative to side arm 30 since side arm 30 attaches preferably to one location on the vehicle. In addition, main beam 20 comprises a first segment 26 and a second segment 28 to allow beam 20 to be collapsible for easy storage of vehicle repairing device 1. As shown in FIG. 2, an extension member 29, shown in dashed lines, allows segment 28 to be extended outward for increasing the length of main beam 20. Segments 26 and 28 and extension member 29 are suitably attached with bolts or combination of welds and bolts. FIG. 2A illustrates main beam 20 in which interchangeable extension member 29' allows first segment 26 and second segment 28 to be extended a greater distance than that shown in FIG. 2 thereby increasing the range in which main beam 20 can attach to a vehicle.

Main beam 20 and side arm 30 are preferably pivotally attachable to each other so as to readily allow angle A therebetween to be varied from about 20 degrees to about 70 degrees, and desirably, from about 30 degrees to about 60 degrees. A generally semi-circular pivot plate 50 is mounted to a top surface of main beam 20, so that portions of plate 50 extend outward from main beam 20.

In the embodiment illustrated in FIG. 2, pivot plate 50 is provided with a downwardly depending pin 52 and a plurality of through holes 54 spaced-apart along a curve. A proximal end 34 of side arm 30 comprises an elongated cutout 36 and an internally threaded hole (not shown), both along the top surface of side arm 30. In particular, elongated cutout 36 of side arm 30 is positioned around pin 52, the threaded hole of side arm 30 is aligned with one of holes 54 of pivot plate 50, and a bolt (not shown) threadably attaches to side arm 30 to thus lock side arm 30 in a fixed angular position relative to main beam 20.

Figure 2B:
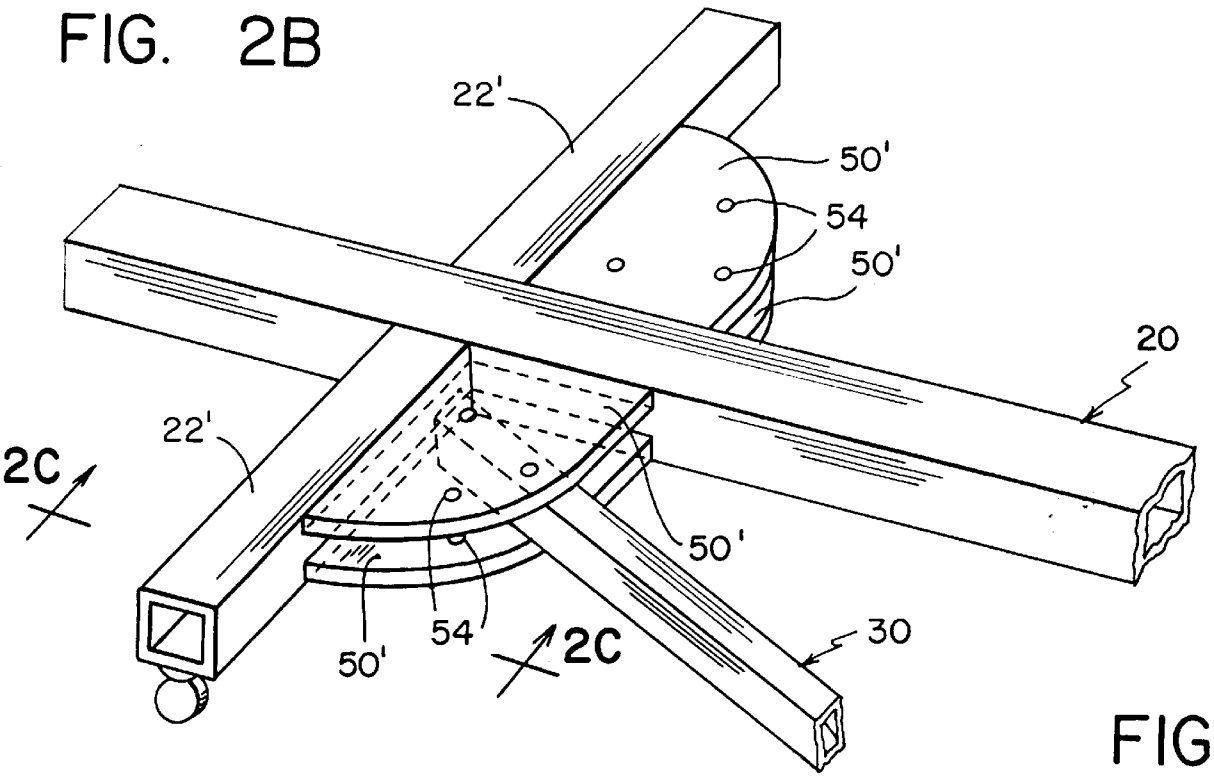
FIG. 2B is a perspective view of an alternative embodiment for attaching the side arm to the main beam.
Figure 2C:
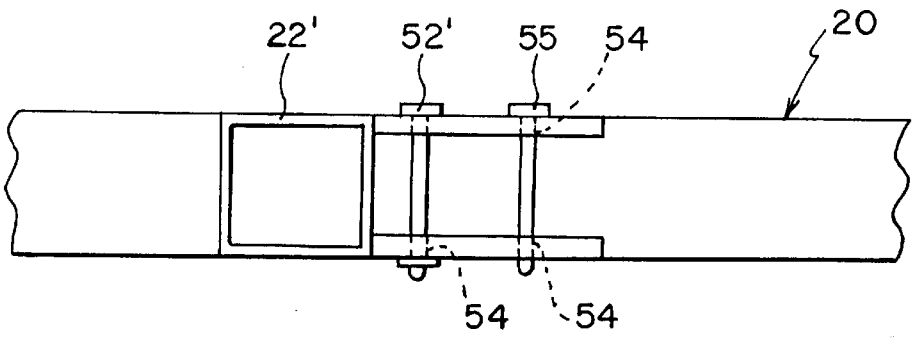
FIG. 2C is a sectional view taken along line 2C—2C of FIG. 2B.

From the present description it will be appreciated that upper and lower pivot plates can be attached to a main beam to better secure a side arm in a locked angular position relative to the main beam. For example, FIG. 2B illustrates an alternative embodiment for pivotally attaching main beam 20 to side arm 30. In this illustrated embodiment, four quarter plates 50' are provided defining a first set of upper and lower quarter plates disposed on one side of main beam 20 and a second set of upper and lower quarter plates disposed on the opposite side. Desirably, side supports 22' are square beams and each of the quarter plates are attached along respective orthogonal edges, e.g., by welding, to both main beam 20 and side support 22'. As shown in FIG. 2C, a bolt 52' extends between upper and lower quarter plates for engaging cutout 36 in side arm 30 (FIG. 2). A removable pin 55 sized so as to extend between holes 54 in the upper and lower quarter plates passes through side arm 30 and readily releasably locks side arm 30 to main beam 20. As shown in FIG. 2B, holes 54 are positioned so that side beam 30 will be disposed at either a 23 degree angle or a 45 degree angle.

Figure 3:
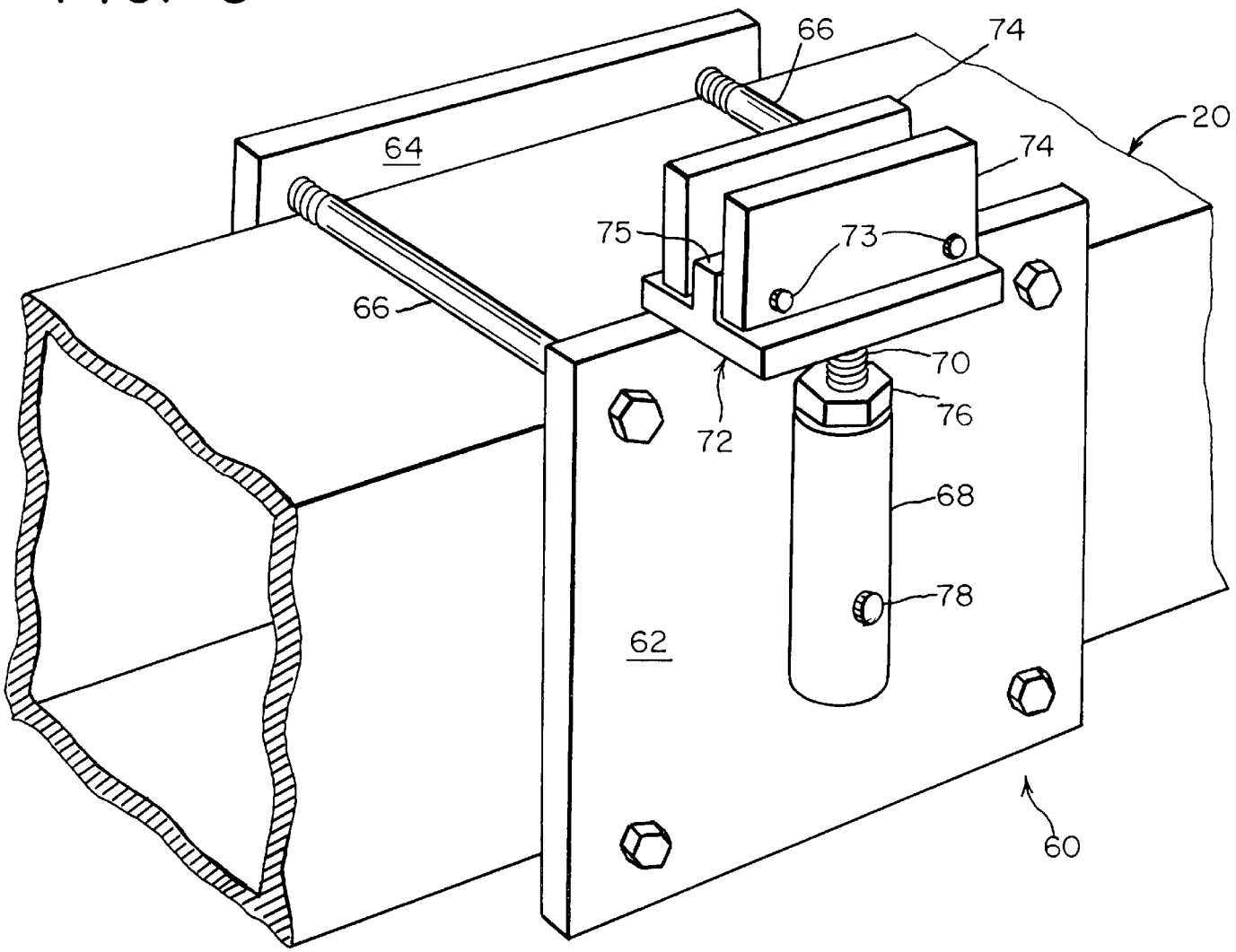
FIG. 3 is a perspective view of a clamp shown in FIG. 1.

Clamps 60 and 80 are slidably mountable on main beam 20 and side arm 30, respectively, and attach main beam 20 and side arm 30 to a vehicle at various locations, such as to a unibody at various pinch weld locations. As shown in FIG. 3, clamp 60 comprises a first plate 62 and a second plate 64 which are disposed on opposite sides of main beam 20 and are connected together by four bolts 66. By tightening bolts 66, plates 62 and 64 are securely mounted and fixed in position on main beam 20. Attached to plate 62 is an upright cylindrical tube 68 which receives a threaded rod 70 which is pivotally retained therein.

Attached to the upper end of threaded rod 70 is a generally inverted T-shaped member 72. A pair of clamping plates 74 for clamping to a pinch weld of a unibody are attached by bolts 73 to an upwardly extending portion 75 of T-shaped member 72. Desirably, the upper ends of clamping plates 74 are angled toward each other to better apply a clamping force therebetween. A nut 76 attaches to threaded rod 70 to allow height adjustment of clamping plates 74 relative to main beam 20. In addition, a threaded bolt 78 extends through the wall of cylindrical tube 68 to bear against threaded rod 70 and lock the same in place. Clamp 80 which is slidably mountable on side arm 30 is essentially the same as that described above with reference to clamp 60.

Figure 4:
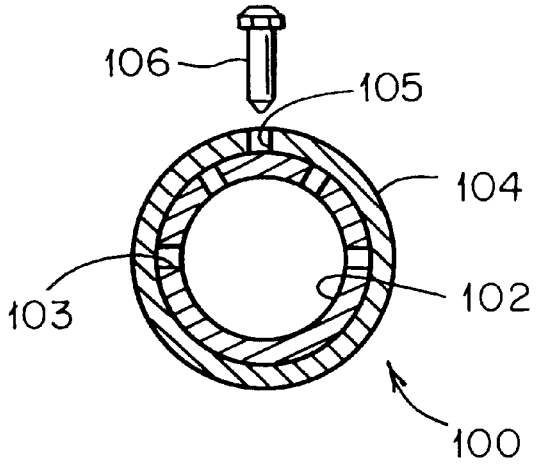
FIG. 4 is a view taken in the direction of line 4—4 shown in FIG. 1.

With reference again to FIG. 1, a tower 90, a beam extension 100 and a hydraulic cylinder 110 attach to main beam 20 for applying a repairing force to a vehicle. The lower end of tower 90 is pivotally connected via pin 94 to one end of beam extension 100 so that tower 90 can be moved in the directions of curved double-headed arrow B, by expansion and contraction of hydraulic cylinder 110 diagonally disposed between tower 90 and beam extension 100 in the directions of double headed arrow C. A plurality of fingers 92 extend outward from tower 90 so that one end of a chain (not shown) can be attached or supported by one of fingers 92 and the other end of the chain can be attached to the vehicle. In addition, beam extension 100 is attachable to main beam 20 and is rotatable relative thereto about a longitudinal axis of main beam 20 as illustrated by double headed arrow D. Specifically, as shown in FIG. 4, beam extension tube 100 comprises an inner circular ring member 102 and an outer circular ring member 104 which are pivotally locked in an angular position by a pin 106 extending through aligned holes 103 and 105, respectively.

Figure 5:
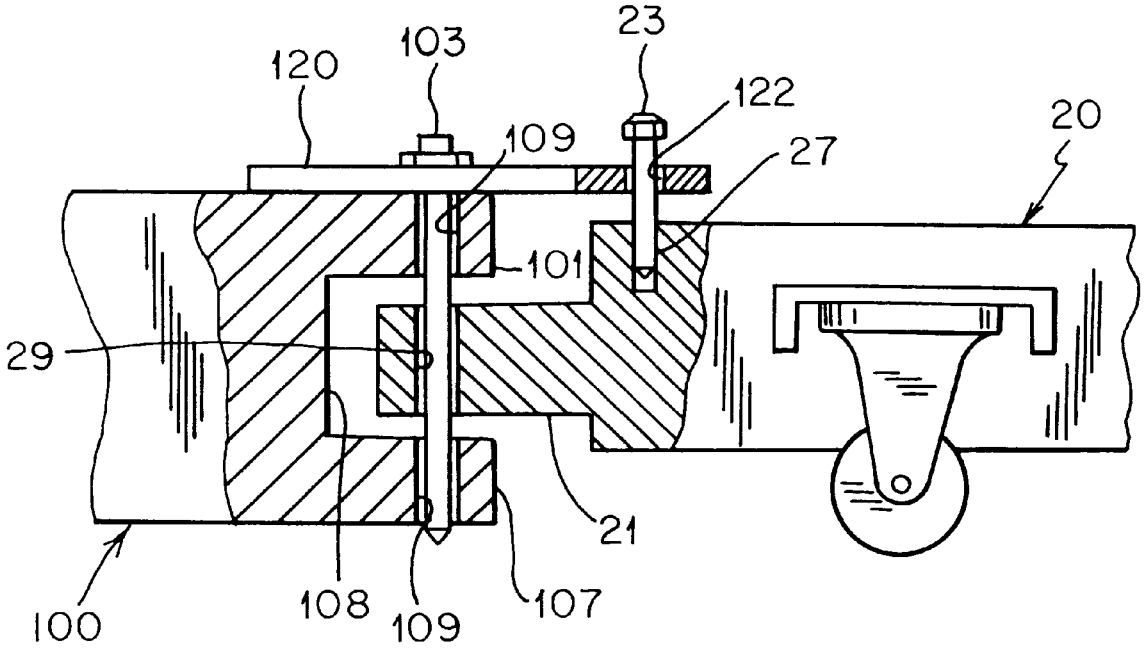
FIG. 5 is a side elevational view, parts thereof is broken away, of the pivot connection between a main beam and a beam extension shown in FIGS. 1 and 2.

As shown in FIGS. 1 and 2, beam extension 100 is pivotally connected to main beam 20 so as to be pivotable about a vertically extending axis in the directions of double headed arrow E. Specifically, a generally circular plate 120 having a plurality of through holes 122 arranged along a curve and spaced from one another is attached to beam extension 100 at the end opposite tower 90. As shown in FIG. 5, main beam 20 comprises a tongue 21 which is receivable in a groove 108 in beam extension 100. A pin 103 is inserted through holes 109 in segments 101 and 107 of beam extension 100 and hole 29 in tongue 21. A pin 23 is inserted through hole 122 in plate 120 and hole 27 in main beam 20. Thus, pins 103 and 23 readily lock beam extension 100 and main beam 20 in a fixed angle therebetween.

Figure 1A:
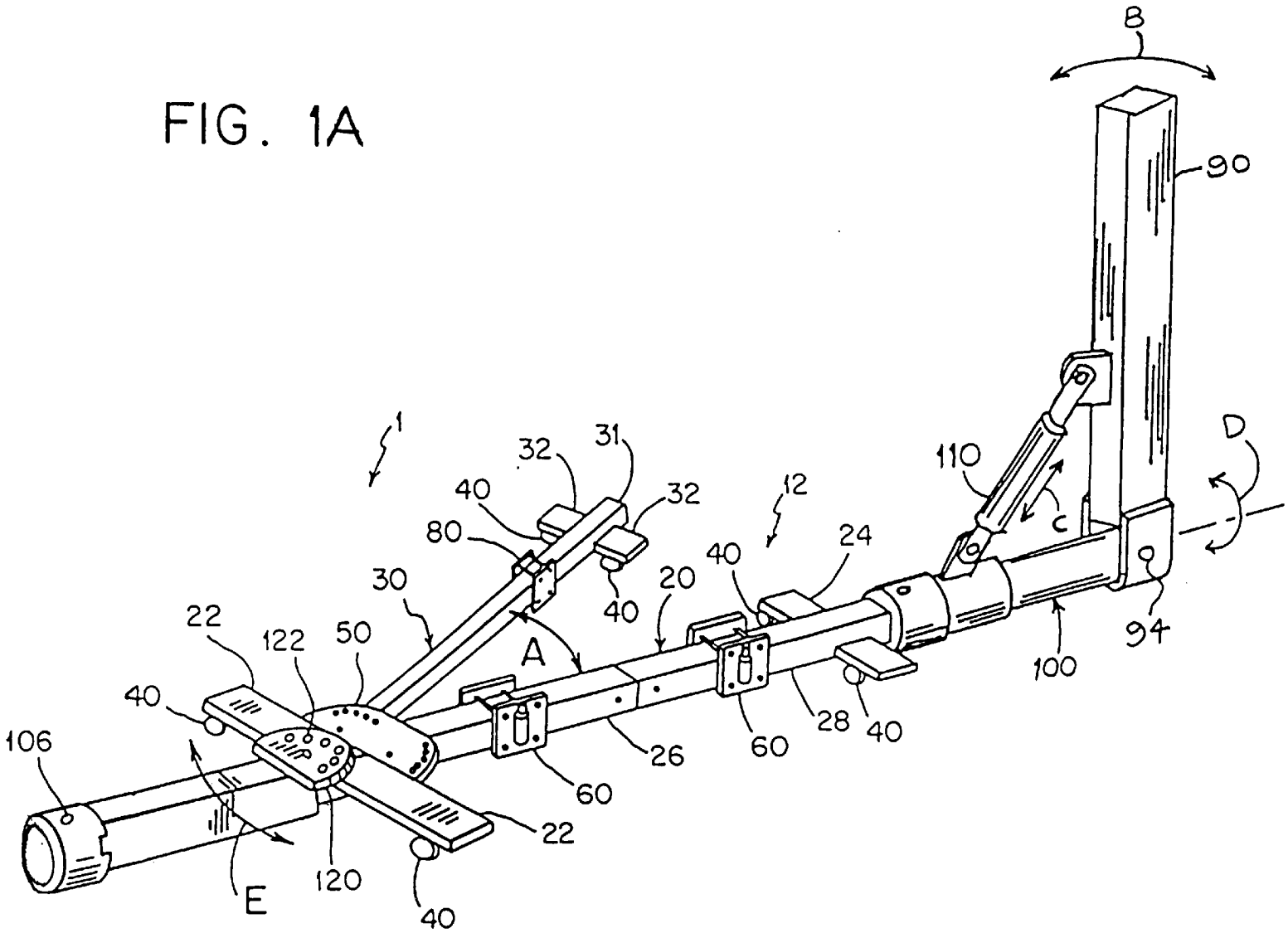
FIG. 1A is a perspective view of a vehicle repairing device shown in FIG. 1 in which the tower, the beam extension, and the hydraulic cylinder are attached to the opposite end of the main beam.

As shown in FIG. 1A, tower 90, beam extension 100, and hydraulic cylinder 110 is selectively attachable so as to be attachable to the opposite end of main beam 20, e.g., the free end of segment 28. This setup increases the range in which vehicle repairing device 1 can be positioned for repair of damaged portions of a vehicle.

Figure 6:
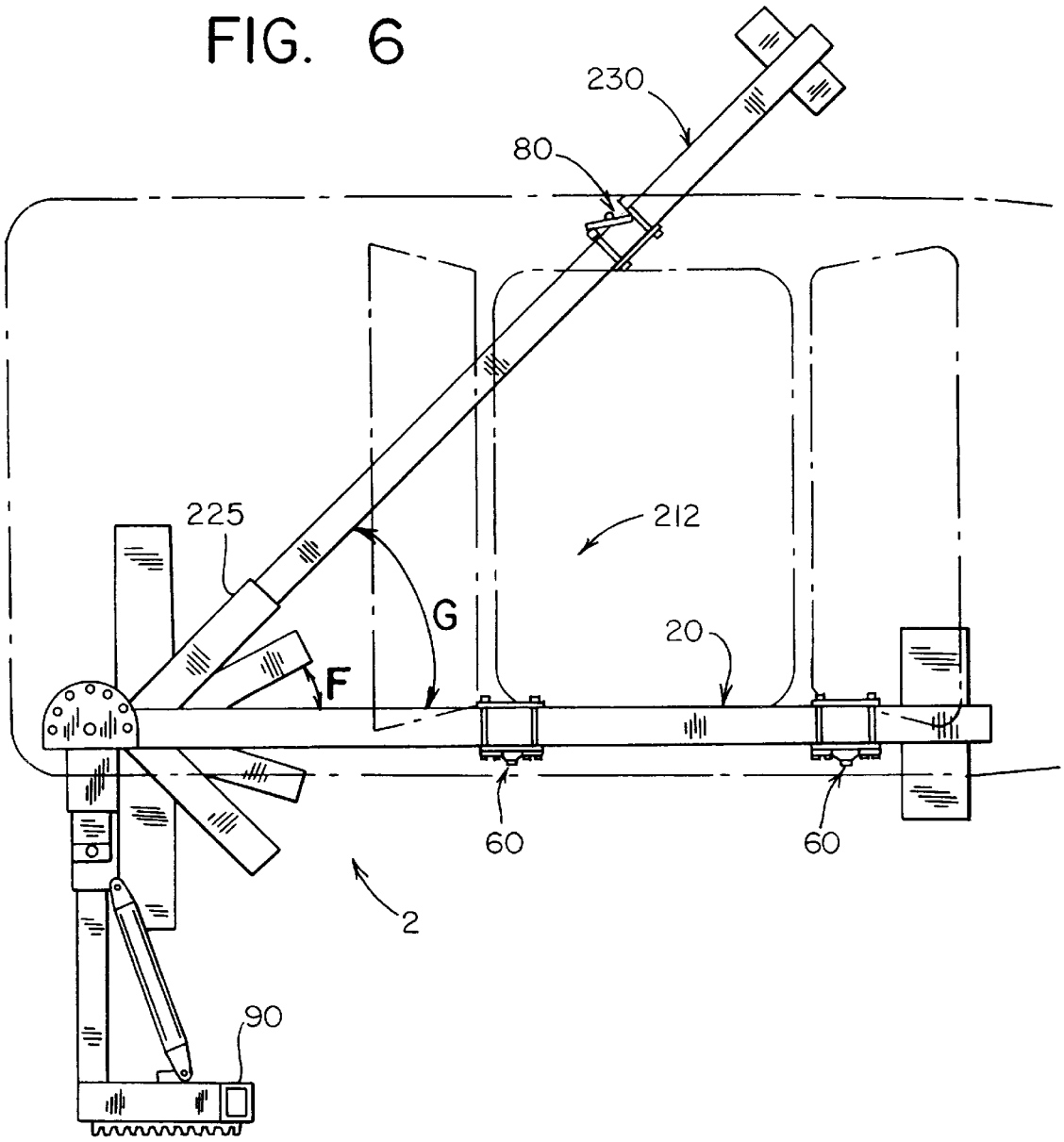
FIG. 6 is a top plan view of an alternative embodiment of a vehicle repairing device in which the device is attached to a vehicle which is shown in phantom lines.

FIG. 6 illustrates an alternative embodiment of the present invention for a vehicle repairing device 2. Vehicle repairing device 2 is essentially the same as vehicle repairing device 1, except that a V-shaped base 212 thereof comprises a plurality of relatively short angled open tubular members 225 which telescopically receive therein a side arm 230. Desirably, members 225 are disposed on both sides of main beam 20 so as to define an angle F and an angle G which are about 23 degrees and about 45 degrees from a main beam 20.

In addition, FIG. 6 illustrates one possible orientation of vehicle repairing device 2 for repairing a vehicle shown in phantom lines. In this orientation, vehicle repairing device 2 is readily attached to a vehicle such as a unibody by attaching main beam 20 to two locations along one side of the vehicle via clamps 60 and attaching side arm 230 to the opposite side of the vehicle at a third location via clamp 80 which is pivoted slightly to align with a pinch weld. Although, vehicle repairing device 2 can readily repair vehicle damage to either the front end or rear end of a vehicle, i.e., with a beam extension disposed in-line with a main beam, as illustrated in FIG. 6, tower 90 can be readily disposed generally parallel to main beam 20 so that side impact damage can be readily repaired, particularly with such a three point attachment between V-shaped base 212 and the vehicle. From the present description, it will be appreciated that the described vehicle repairing devices can be attached to a vehicle in numerous other orientations for repairing a vehicle.

Figure 7:
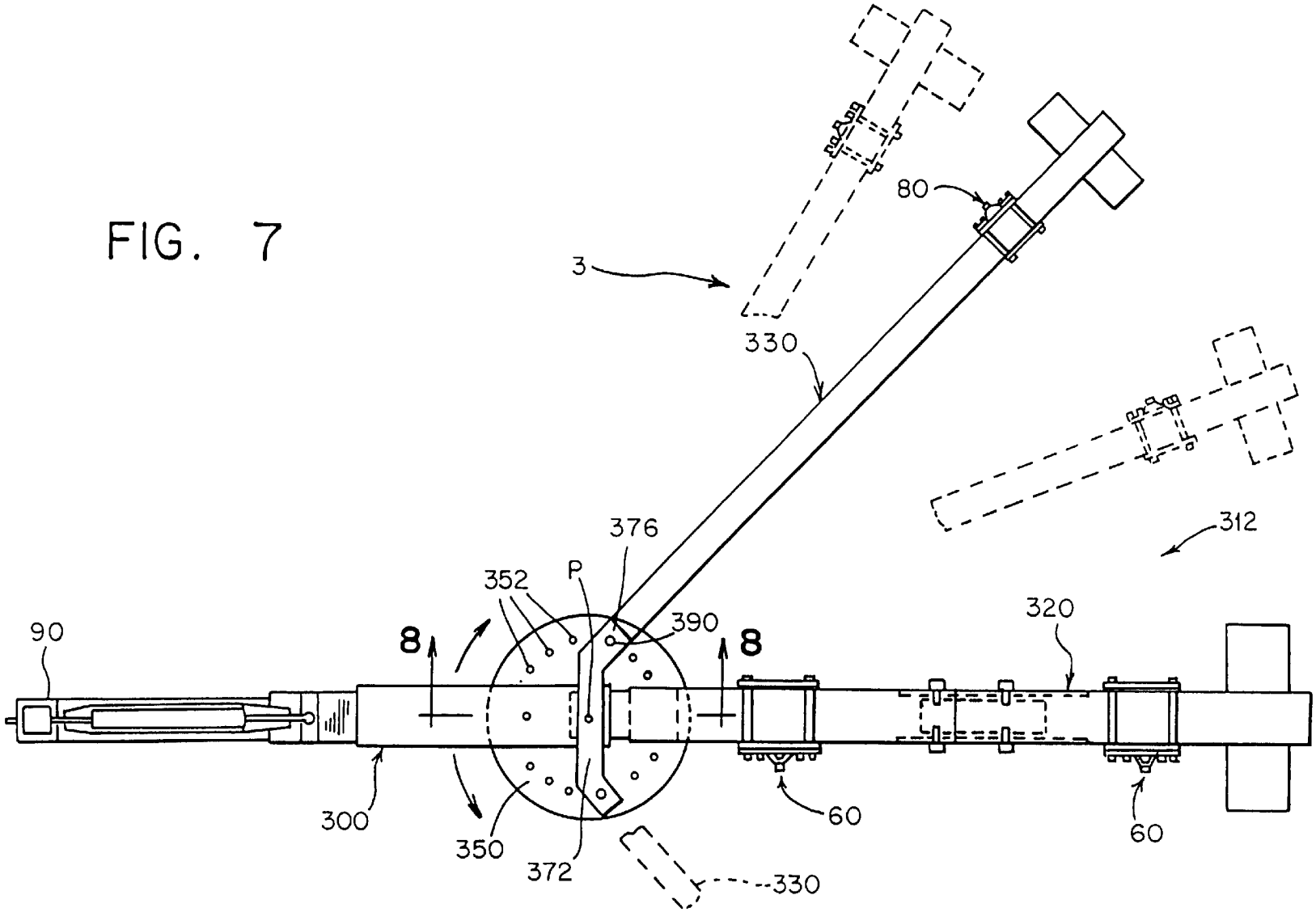
FIG. 7 is a top plan view of still another alternative embodiment of a vehicle repairing device.

FIG. 7 illustrates an alternative embodiment of the present invention for a vehicle repairing device 3. Vehicle repairing device 3 is similar to vehicle repairing device 1, except that a V-shaped base 312, having a main beam 320 and side arm 330, operably attach to each other and to tower 90 attach via a single pivot point P.

Figure 8:
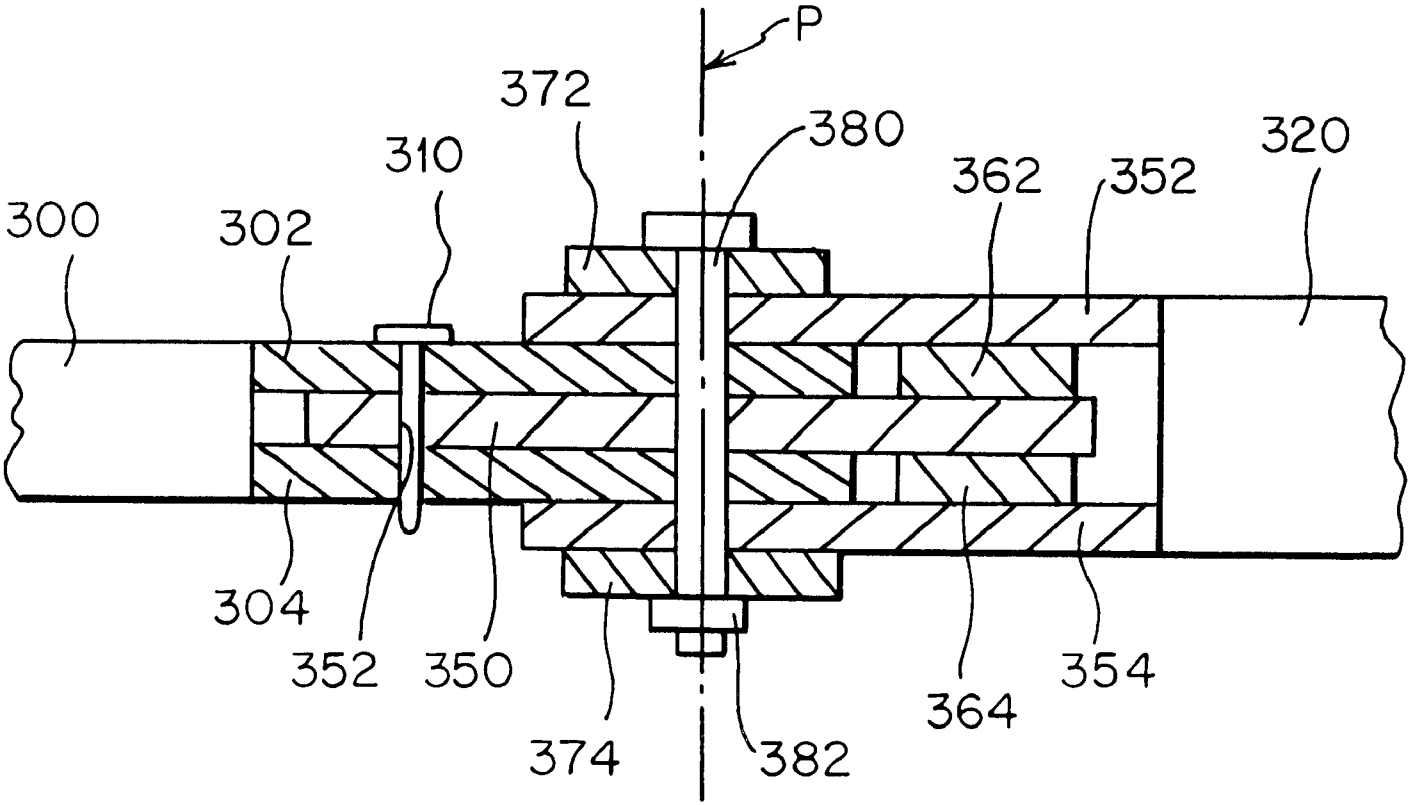
FIG. 8 is a cross-sectional view taken along line 8—8 in FIG. 7.

In this embodiment main beam 320 is fixedly attached to a circular plate 350 so that circular plate 350 remains in a fixed position relative to main beam 320. With reference to FIG. 8, a top member 352 and a bottom member 354 of main beam 320 are respectively attached to spacers 362 and 364 which are attached to circular plate 350.

As further illustrated in FIG. 8, beam extension 300 which attaches to tower 90 includes a top member 302 and a bottom member 304 which extends between the space formed by circular plate 350, and respectively, top member 362 and bottom member 364 of main beam 320. Side arm 330 (FIG. 7) is pivotally attached about pivot P by side arm brackets 372 and 374 which are respectively disposed on top of top member 352 and below bottom member 354 of main beam 320.

More specifically, circular plate 350, beam extension 300, main beam 320, and side arm brackets 372 and 374 are provided with axially aligned holes through which extend a bolt 380. Bolt 380 attaches to nut 382 to retain circular plate 350, beam extension 300, main beam 320, and side arm brackets 372 and 374 thereon, but allow pivotable movement therebetween.

Referring again to FIG. 7, side arm brackets 372 and 374 are generally U-shaped when viewed from above having upper ends 376 which suitably attach to side arm 330. Side arm 330 is pivotable between, e.g., the positions shown in dashed lines in FIG. 7. In addition, side arm 330 is positioned on either side of main beam 320. Further, tower 90 is rotatable about pivot point P in the direction of the curved arrows in FIG. 7.

Tower 90 is maintained in a locked angular position with respect to main beam 320 via a pin 310 which extends through holes in top member 320 of beam extension 300, circular plate 350, and bottom member 304 of beam extension 300. A plurality of holes 352 in circular plate 350 allow adjusting the angle between tower 90 and main beam 320. Side arm 330 is maintained in a locked angular position with respect to main beam 320 via a pin 390 which extends through top side arm bracket 374. Holes 352 also allow adjusting the angle of side arm 330 with respect to main beam 320.

From the present description, it will be further appreciated that the vehicle repairing devices disclosed herein are significantly more compact and more particularly suitable for repairs on unibody vehicles than the prior art. Furthermore, the vehicle repair devices of the present invention can be attached to a vehicle more quickly and easily than the more cumbersome devices of the prior art. For example, the vehicle repairing devices of the present invention can be attached to a vehicle by jacking up one wheel thereof, removing the wheel, and sliding a main beam under the vehicle. The clamps can then be adjusted and connected to the pinch weld of the unibody. Once the main beam and side arm are connected to the vehicle, a repairing force can be subsequently applied.

What is claimed is:

1. A device for straightening damaged unibodies of vehicles comprising:

a first elongated member which is selectively positionable under a damaged unibody of a vehicle while three wheels of the vehicle rest on the ground, said first elongated member comprising a first end and a second end;

a second elongated member selectively attachable to said first elongated member at an angle of less than 90 degrees;

two clamps slidably mounted on said first elongated member for attaching said first elongated member to pinch welds of said damaged unibody;

a clamp slidably mounted on said second elongated member for attaching said second elongated member to a pinch weld of said damaged unibody; and means for applying a pulling force selectively connectable to at least one of said first end and said second end of said first elongated member.

2. A device according to claim 1 wherein said two clamps attach said first elongated member to pinch welds of said damaged unibody at at least two different locations.

3. A device according to claim 2 wherein said clamp slidably mounted on said second elongated member attaches to a pinch weld of said damaged unibody at at least one location different from said at least two different locations.

4. A device according to claim 1 further comprising means for pivoting said first elongated member with respect to said second elongated member so as to vary the angle therebetween.

5. A device according to claim 4 wherein said pivoting means comprises at least one pivot plate attached to said first elongated member for pivotally attaching to said second elongated member.

6. A device according to claim 4 wherein said pivoting means comprises four quarter plates attached to said first elongated member in which two spaced quarter plates laterally extend from one side of said first elongated member and two spaced quarter plates laterally extend from the opposite side.

7. A device according to claim 6 further comprising locking means comprising a first pin and a second pin extending between said spaced quarter plates which interlock with said second elongated member.

8. A device according to claim 1 further comprising means for locking said angle between said first elongated member and said second elongated member.

9. A device according to claim 1 wherein said first elongated member comprises at least one open tubular member attached thereto for telescopically receiving therein said second elongated member.

10. A device according to claim 9 wherein said open tubular member is angled at at least one of about 23 degrees and about 45 degrees from said first elongated member.

11. A device according to claim 1 wherein said angle is about 20 degrees to about 70 degrees.

12. A device according to claim 1 wherein said angle is about 30 degrees to about 60 degrees.

13. A device according to claim 1 wherein said first elongated member is telescopic.

14. A device according to claim 1 wherein said first elongated member is extendable.

15. A device according to claim 1 further comprising means for attaching said means for applying a pulling force, said means for attaching said means for applying a pulling force attached to said first elongated member.

16. A device according to claim 1 wherein said means for applying a pulling force comprises a hydraulic cylinder.

17. A device according to claim 15 wherein said means for attaching said means for applying a pulling force comprises a tower attached to a beam extension.

18. A device according to claim 17 further including means for rotating said tower about a longitudinal axis of said beam extension.

19. A device according to claim 18 further including means for pivoting said beam extension relative to said first elongated member about a vertically extending axis.

20. A device for straightening damaged unibodies of vehicles comprising:

a first elongated member which is selectively positionable under a damaged unibody of a vehicle while three wheels of the vehicle rest on the ground, said first elongated member comprising a first end and a second end;

a second elongated member selectively attachable to said first elongated member at an angle of less than 90 degrees;

means for applying a pulling force selectively connectable to at least one of said first end and said second end of said first elongated member; and means for attaching said first and second elongated members to said damaged unibody consisting of:

a first and second clamp slidably mounted on said first elongated member for attaching said first elongated member to pinch welds of said damaged unibody; and a third clamp slidably mounted on said second elongated member for attaching said second elongated member to a pinch weld of said damaged unibody.

21. A device according to claim 20 further comprising means for pivoting said first elongated member with respect to said second elongated member so as to vary the angle therebetween.

22. A device according to claim 20 further comprising means for attaching said means for applying a pulling force, said means for attaching said means for applying a pulling force attached to said first elongated member.

* * * * *